US010764688B2

(12) United States Patent
Zhang

(10) Patent No.: US 10,764,688 B2
(45) Date of Patent: Sep. 1, 2020

(54) SPEAKER

(71) Applicant: AAC Technologies Pte. Ltd., Singapore (SG)

(72) Inventor: Guqing Zhang, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/524,071

(22) Filed: Jul. 28, 2019

(65) Prior Publication Data

US 2020/0045456 A1 Feb. 6, 2020

(30) Foreign Application Priority Data

Aug. 5, 2018 (CN) ..... 2018 2 1262008 U

(51) Int. Cl.
*H04R 9/06* (2006.01)
*H04R 9/02* (2006.01)
*H04R 7/18* (2006.01)

(52) U.S. Cl.
CPC ..... *H04R 9/06* (2013.01); *H04R 9/02* (2013.01); *H04R 7/18* (2013.01); *H04R 2400/11* (2013.01); *H04R 2499/11* (2013.01)

(58) Field of Classification Search
CPC ..... H04R 9/06; H04R 9/025; H04R 9/043; H04R 9/047; H04R 1/06; H04R 2499/11; H04R 31/006; H04R 9/02; H04R 1/00; H04R 1/021; H04R 1/023
USPC ..... 381/400, 401, 433, 191, 354, 398, 397, 381/396, 408, 410, 412, 420
See application file for complete search history.

(56) References Cited

U.S. PATENT DOCUMENTS

2013/0082546 A1* 4/2013 Kim ..... H02K 33/16 310/25
2014/0119592 A1* 5/2014 Choi ..... H04R 9/025 381/412
2016/0227322 A1* 8/2016 Xu ..... H04R 1/021
2017/0099548 A1* 4/2017 Schoeffmann ..... H04R 1/288

* cited by examiner

*Primary Examiner* — Fan S Tsang
*Assistant Examiner* — Julie X Dang
(74) *Attorney, Agent, or Firm* — W&G Law Group LLP

(57) ABSTRACT

The present disclosure provides a speaker, including a holder, a magnetic circuit unit, a vibration unit, and an electrical connection member. The vibration unit includes a diaphragm and a voice coil. The electrical connection member is electrically connected to the voice coil. The magnetic circuit unit includes a yoke. A pad fixed to the holder is formed at an end of the electrical connection member facing away from the voice coil. The yoke includes a bottom plate exposed out of the holder, and a recess is formed at a side of the bottom plate facing away from the diaphragm. The speaker further includes a printed circuit board connected to the pad. The printed circuit board electrically connects the electrical connection member with an external circuit, and the printed circuit board is received in the recess and extends to the pad.

13 Claims, 8 Drawing Sheets

SPEAKER

TECHNICAL FIELD

The present disclosure relates to the field of acoustic-electrical conversion, and in particular, to a speaker used in portable electronic products.

BACKGROUND

With the advent of the mobile Internet era, the number of smart mobile devices continues to rise. Among the numerous mobile devices, mobile phones are undoubtedly the most common and portable mobile terminal devices. At present, functions of the mobile phones are extremely diverse, one of which is high-quality music. Therefore, speakers for playing sound are widely used in today's smart mobile devices.

In the related art, the speaker includes a holder, and a magnetic circuit unit, a vibration unit, a flexible printed circuit board and a conductive terminal that are received in the holder. The vibration unit is electrically connected to the flexible printed circuit board, and the flexible printed circuit board is electrically connected to an external circuit via the conductive terminal. In the speaker of this structure, the conductive terminal generally adopts a metal spring or a metal dome embedded in the holder, so that a larger occupancy space is required, which does not meet the miniaturization requirements of the speaker.

Therefore, it is necessary to provide a new speaker to solve the above problems.

BRIEF DESCRIPTION OF DRAWINGS

Many aspects of the exemplary embodiment can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DESCRIPTION OF EMBODIMENTS

The present disclosure will be further illustrated with reference to the accompanying drawings and the embodiments.

Figure 1:
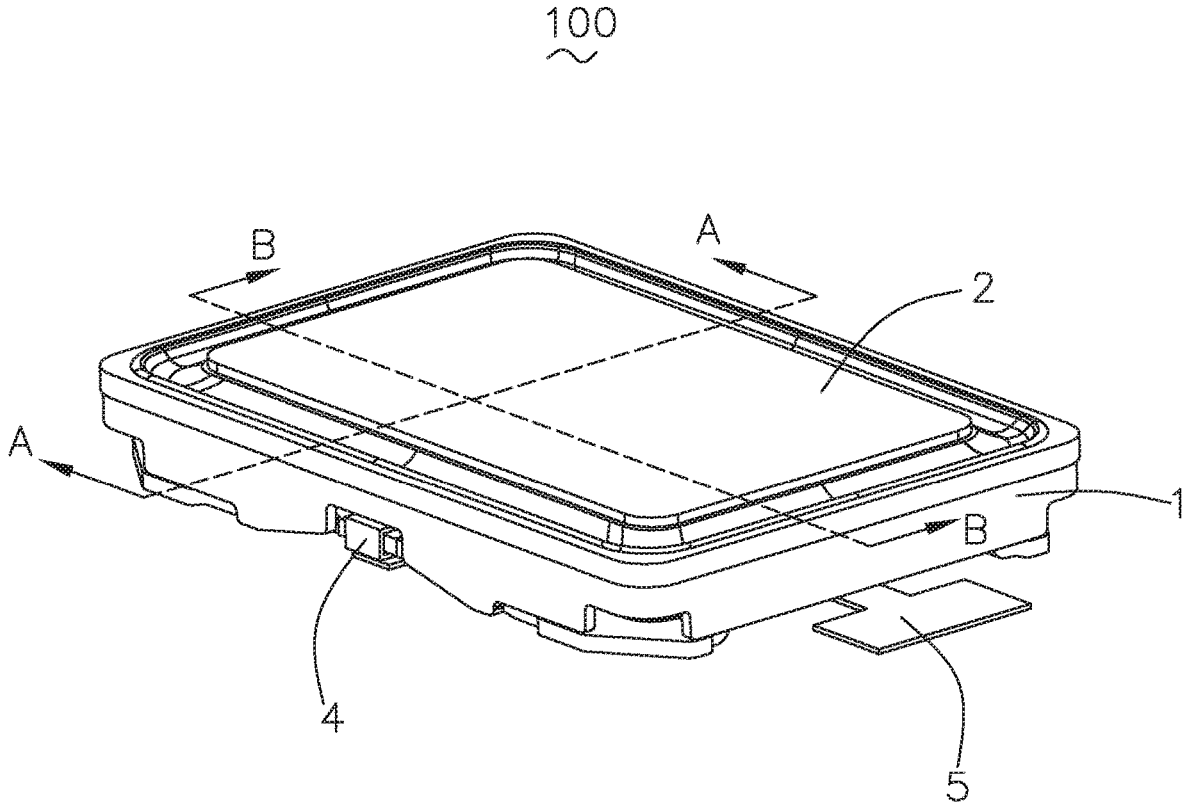
FIG. 1 is a perspective structural schematic diagram of a speaker provided by the present disclosure.
Figure 2:
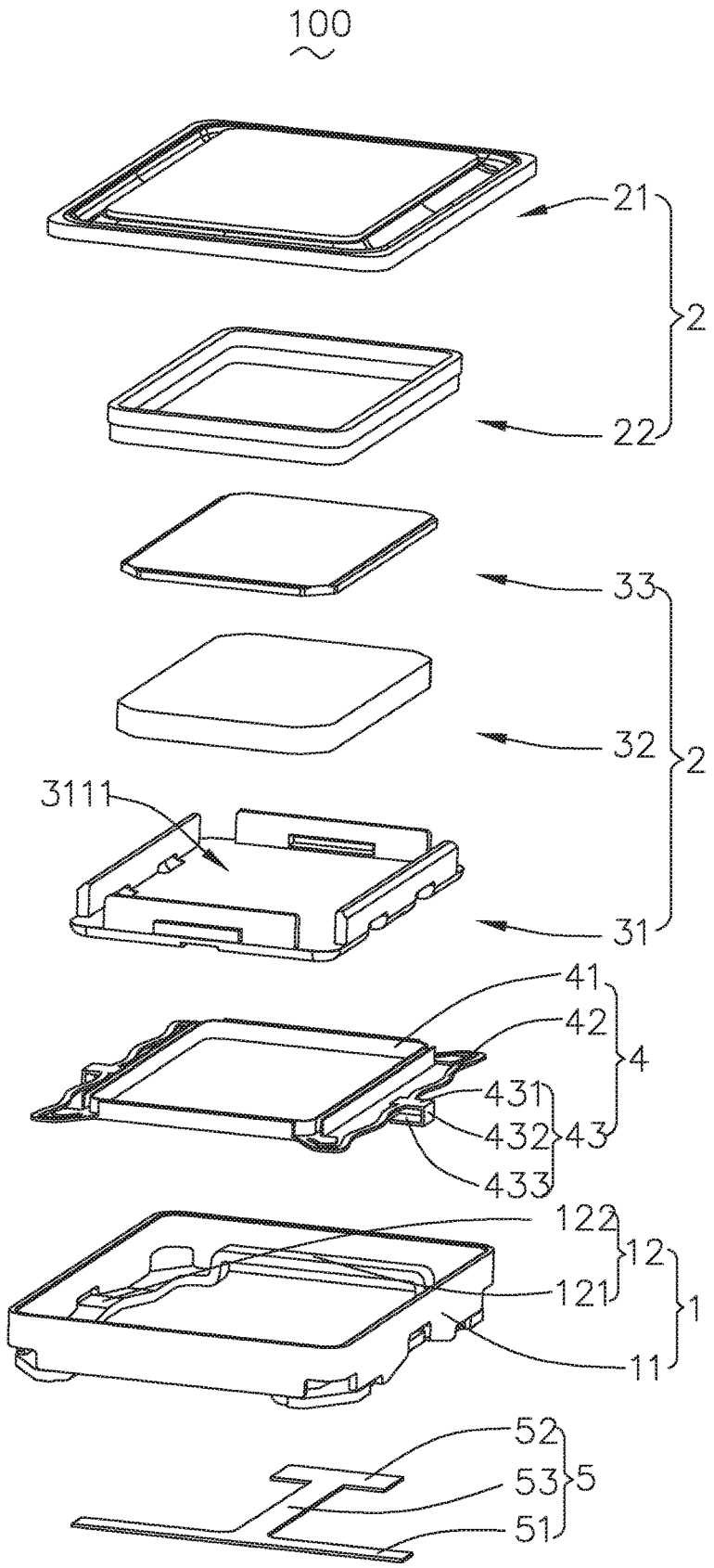
FIG. 2 is an exploded structural schematic diagram of a speaker provided by the present disclosure.

Referring to FIG. 1 and FIG. 2 in conjunction, the present disclosure provides a speaker 100 including a holder 1 having a receiving space, a vibration unit 2 received in the receiving space, a magnetic circuit unit 3 used for driving the vibration unit 2 to vibrate and emit sound, an electrical connection member 4 fixed at the holder 1 and used for supporting the vibration unit 2, and a printed circuit board 5 connected to the electrical connection member 4 and used for achieving electrical connection between the electrical connection member 4 and an external circuit.

The holder 1 has a rectangular frame shape and is configured to receive and protect other components of the speaker 100. As an example, the holder 1 is a metal holder of relatively high strength and includes a frame body 11 enclosing the receiving space and support edges 12 provided at an end of the frame body 11 facing away from the vibration unit 2 and connected to the frame body 11.

The support edges 12 form an opening. Specifically, the support edges 12 include two first side edges 121 arranged opposite to each other and two second side edges 122 arranged opposite to each other. The first side edges 121 and the second side edges 122 are connected, head to tail, to form the opening.

The vibration unit 2 is used to vibrate and emit sound. Specifically, the vibration unit 2 includes a diaphragm 21 used to vibrate and emit sound and a voice coil 22 disposed on a side of the diaphragm 21. The diaphragm 21 is fixedly connected to the frame body 1, and the voice coil 22 is used to drive the diaphragm 21 to vibrate and emit sound.

The magnetic circuit unit 3 is used to drive the vibration unit 2 to vibrate and emit sound. Specifically, the magnetic circuit unit 3 includes a yoke 31 fixedly connected to the holder 1, a magnet 32 assembled to the yoke 31, and a pole plate 33 adhered to a surface of the magnet 32.

Figure 3:
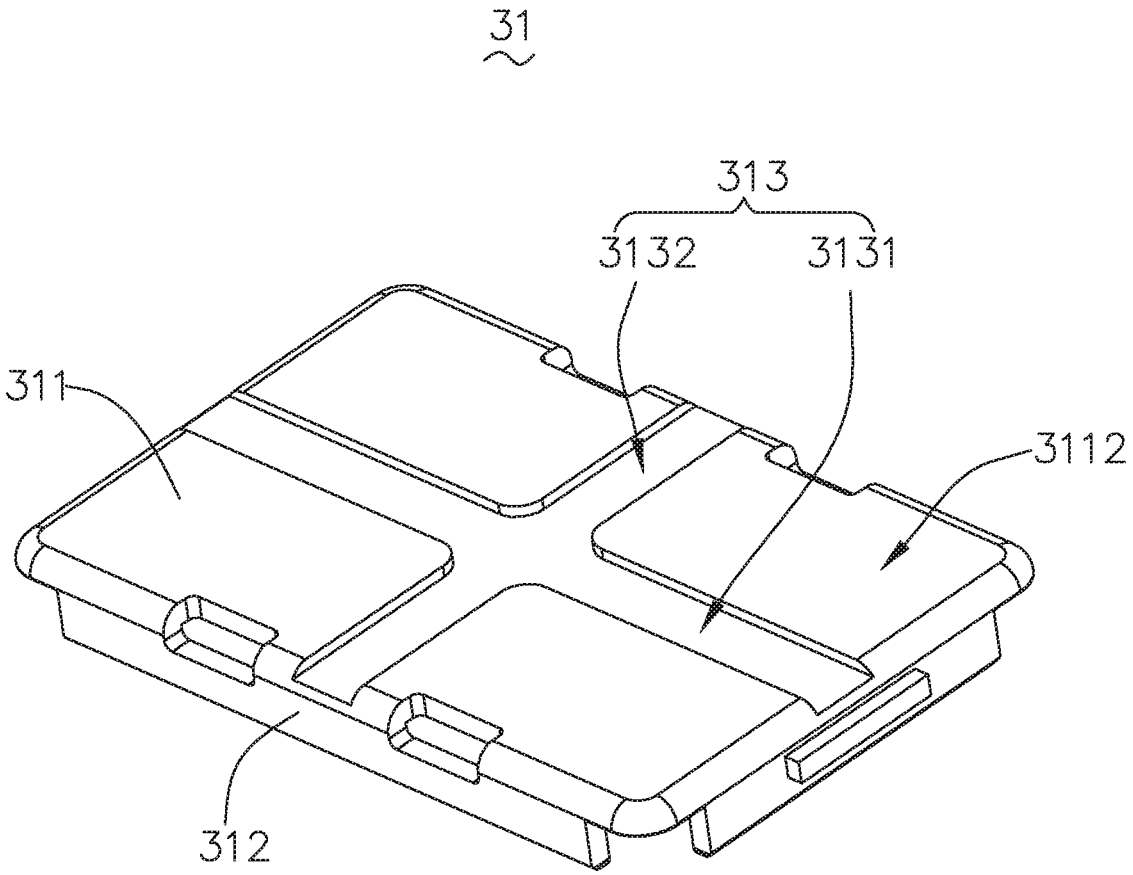
FIG. 3 is a perspective structural schematic diagram of a yoke shown in FIG. 2 when being viewed from another perspective.

Referring to FIG. 3, in the present embodiment, the yoke 31 has a bowl-like structure, and includes a bottom plate 311 exposed out of the holder 1, side plates 312 extending from the bottom plate 311 while being bent towards the diaphragm 21, and a recess 313 provided at a side of the bottom plate 311 facing away from the diaphragm 21. The bottom plate 311 and the side plates 312 cooperate to form a receiving space. The magnet 33 is received in the receiving space, and the side plates 312 form a magnetic gap with the magnet 32. The voice coil 22 is suspended in the magnetic gap.

The bottom plate 311 is exposed via the opening, and includes an upper surface 3111 close to the diaphragm 21 and a lower surface 3112 arranged opposite to the upper surface 3111. The recess 313 is formed by recessing from the lower surface 3112 towards the upper surface 3111.

Further, the recess 313 includes a first recess 3131 provided in parallel with the first side edge 121 and a second recess 3132 provided in parallel with the second side edge 122. The first recess 3131 and the second recess 3132 are in communication.

Further, the first recess 3131 and the second recess 3132 have the same structures, each including a recess bottom wall opposite to the upper surface 3111 and a recess sidewall extending from the recess bottom wall along a direction facing away from the upper surface 3111.

Figure 4:
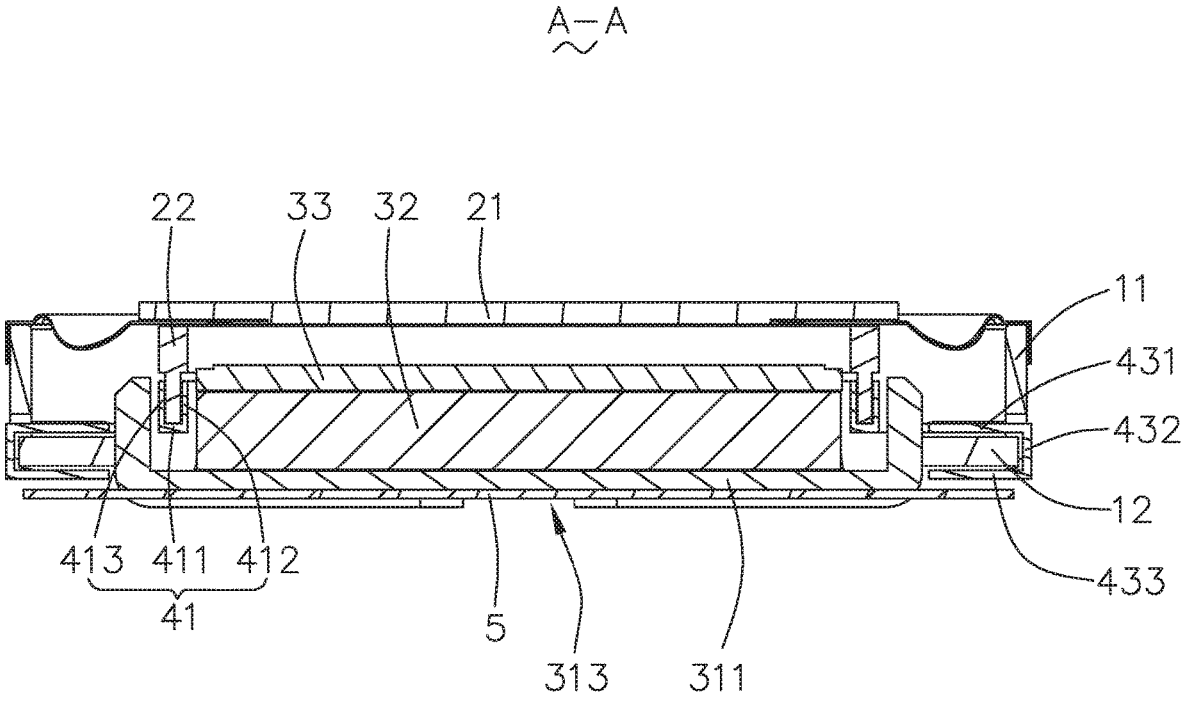
FIG. 4 is a cross-sectional diagram of the speaker shown in FIG. 1 taken along line A-A.

Referring to FIG. 2 and FIG. 4 in conjunction, the electrical connection member 4 is fixedly connected to the holder 1 and elastically supports the voice coil 22. Further, the electrical connection member 4 is electrically connected to the voice coil 22.

Specifically, the electrical connection member 4 includes a body portion 41 that elastically supports the voice coil 22, an elastic arm 42 extending from the body portion 41, and a fitting portion 43 extending from the elastic arm 42 to out of the holder 1. The elastic arm 42 extends from two opposite ends of the body portion 41 towards an opposite side. The elastic arm 42 and the body portion 41 form a ring shape, and the fitting portion 43 is formed at a middle portion of the elastic arm 42.

The body portion 41, in one aspect, supports the voice coil 22, and is, in another aspect, electrically connected to the voice coil 22 for transmitting an external electric signal to the voice coil 22.

Specifically, the body portion 41 includes a support plate 411 facing right towards the diaphragm 21, an inner baffle 412 extending from a side of the support plate 411 facing away from the elastic arm 42 while being bent towards the diaphragm 21, and an outer baffle 413 extending from a side of the support plate 411 close to the elastic arm 42 while being bent towards the diaphragm 21. The support plate 411 has a ring shape, and the voice coil 22 is sandwiched between the inner baffle 412 and the outer baffle 413. It can be understood that the inner baffle 412 and the outer baffle 413 limit a position of the voice coil 22, thereby increasing stability of the connection between the voice coil 22 and the electrical connection member 4.

The fitting portion 43 includes an extension portion 431 extending from the elastic arm 42 along a direction facing away from the receiving space, a connecting portion 432 that is bent and extends from a distal end of the extension portion 431 along a direction facing away from the diaphragm 21, and a pad 433 that is bent and extends from an end of the connecting portion 432 facing away from the extension portion 431. The pad 433 is arranged opposite to the extension portion 431. The support edge 12 is sandwiched between the pad 433 and the extension portion 431. It can be understood that the pad 433 is provided at an end of the electrical connection member 4 facing away from the voice coil 22 and fixedly connected to the holder 1.

The pad 433 is exposed at the support edge 12. Specifically, there are two pads 433 respectively exposed at the first side edges 121. The recess bottom wall of the first recess 3111/the second recess 3132 is coplanar with the pad 433, and the pad 433 is provided at an end of the second recess 3132 facing away from the first recess 3131.

The extension portion 431, the connecting portion 432 and the pad 433 together form a buckle structure having a U-shaped cross section. By providing the buckle structure, the connection strength between the electrical connection member 4 and the holder 1 is increased. By providing the pad 433, the electrical connection member 4 can be directly connected to an external electrical device without additionally providing an external pad, thereby saving the internal space of the speaker 100.

Figure 5:
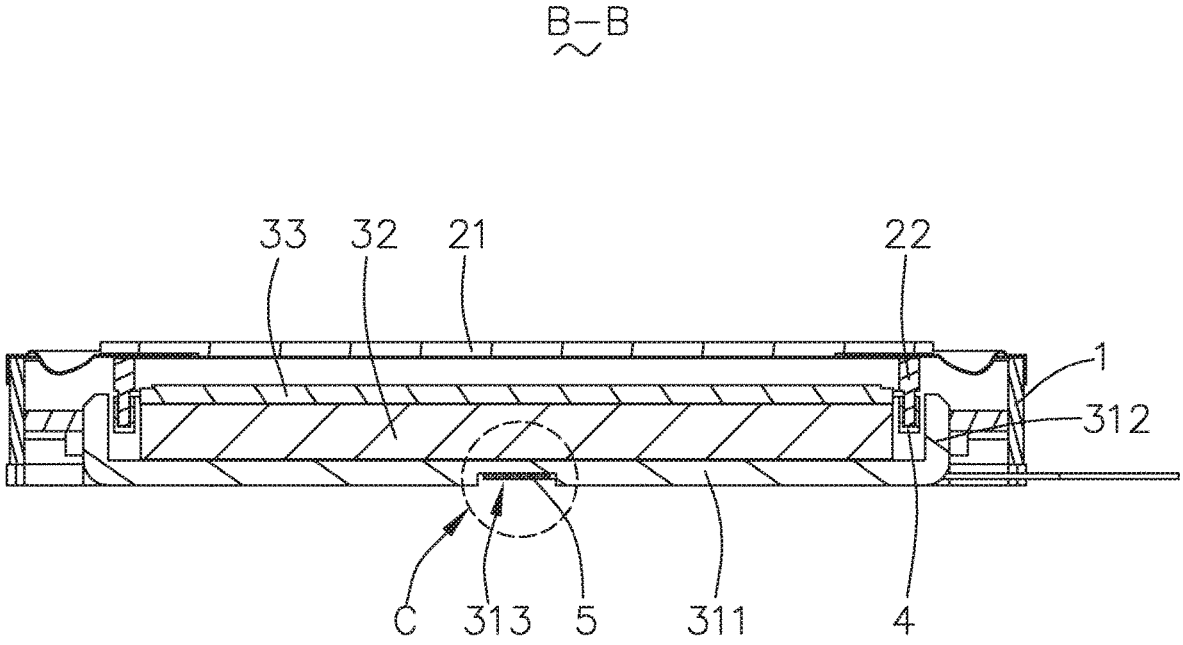
FIG. 5 is a cross-sectional diagram of the speaker shown in FIG. 1 taken along line B-B.
Figure 6:
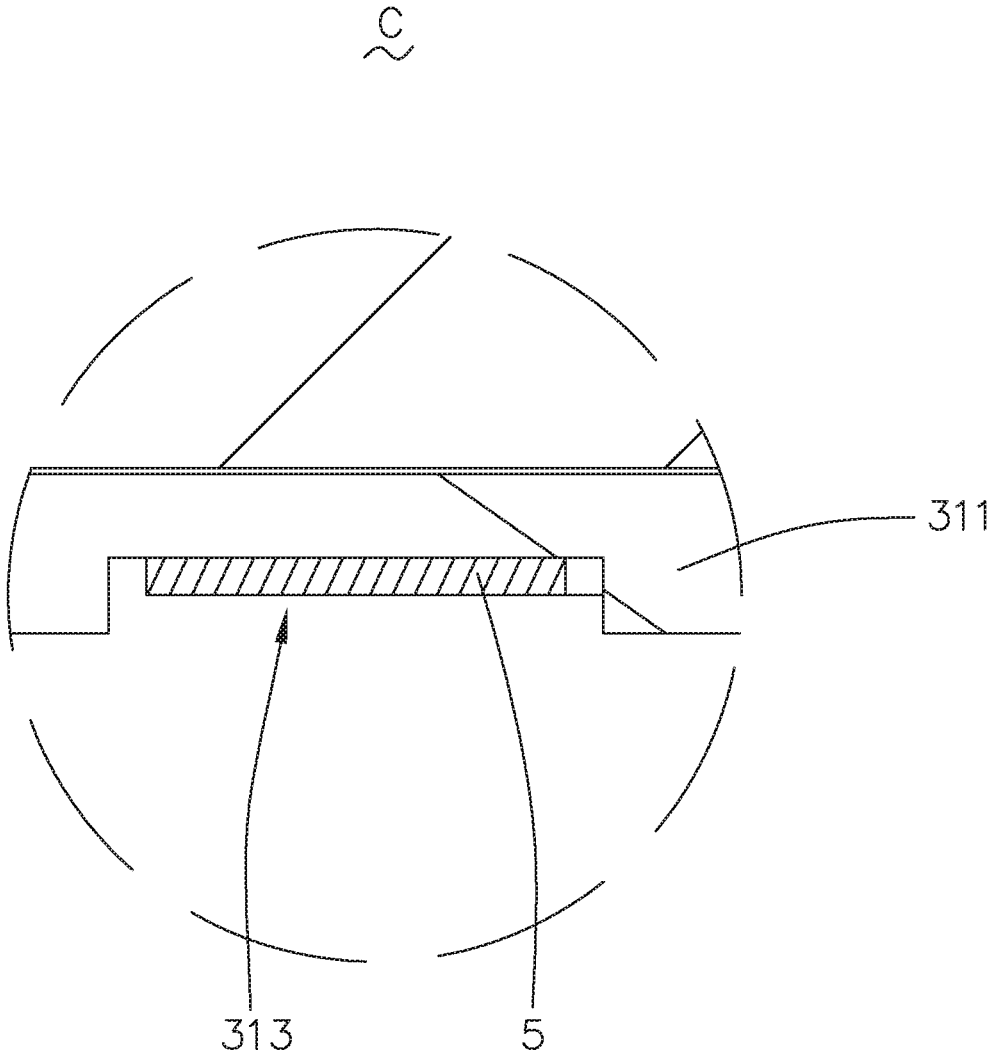
FIG. 6 is an enlarged diagram of the Portion C shown in FIG. 5.

Referring to FIG. 5 and FIG. 6, the printed circuit board 5 is connected to the electrical connection member 4 and used to achieve electrical connection between the electrical connection member 4 and an external circuit. Specifically, the printed circuit board 5 is received in the recess 313 and extends to the pad 433. The printed circuit board 5 matches the recess and is fixedly connected to the recess 313, and a thickness of the printed circuit board 5 is smaller than or equal to a depth of the recess 313. It can be understood that the printed circuit board 5 will not go beyond the lower surface 3112 of the yoke 31, such that the space can be reasonably utilized, and thus a smaller height of the finished product of the speaker 100 can be obtained, thereby meeting the demand for miniaturization.

Figure 7:
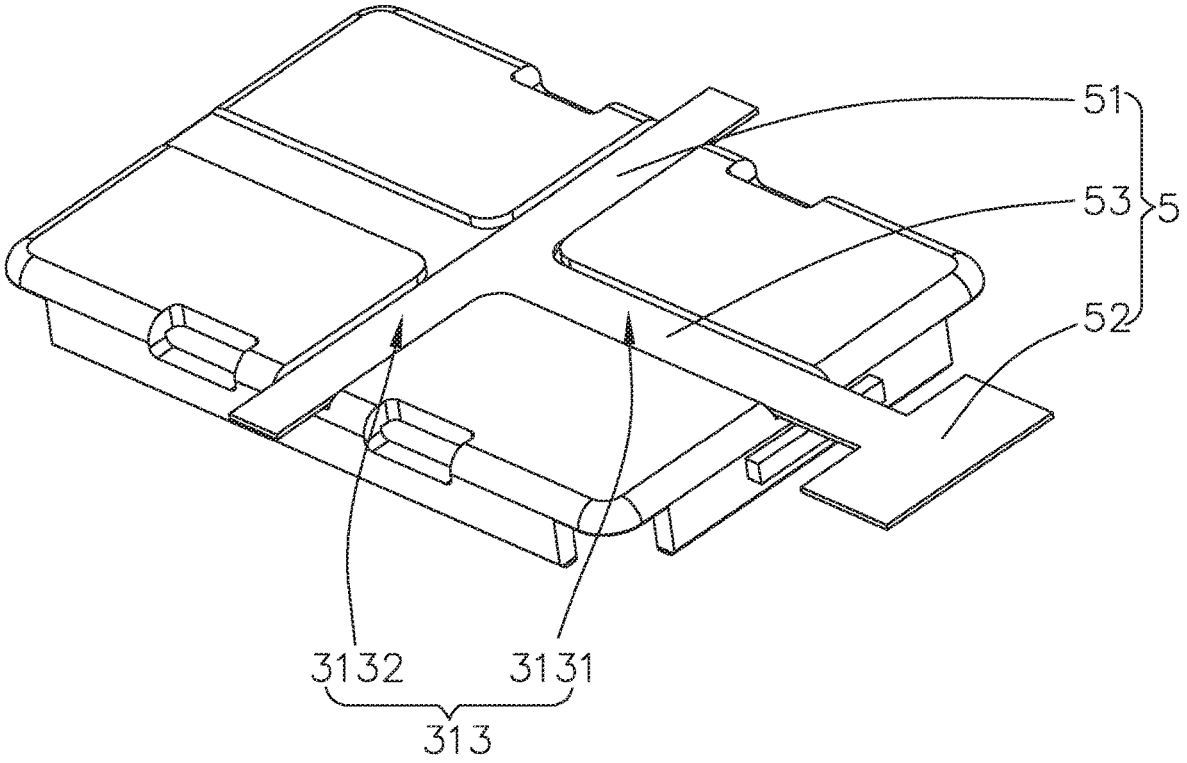
FIG. 7 schematically illustrates a connection relationship between the yoke and a circuit board shown in FIG. 2.
Figure 8:
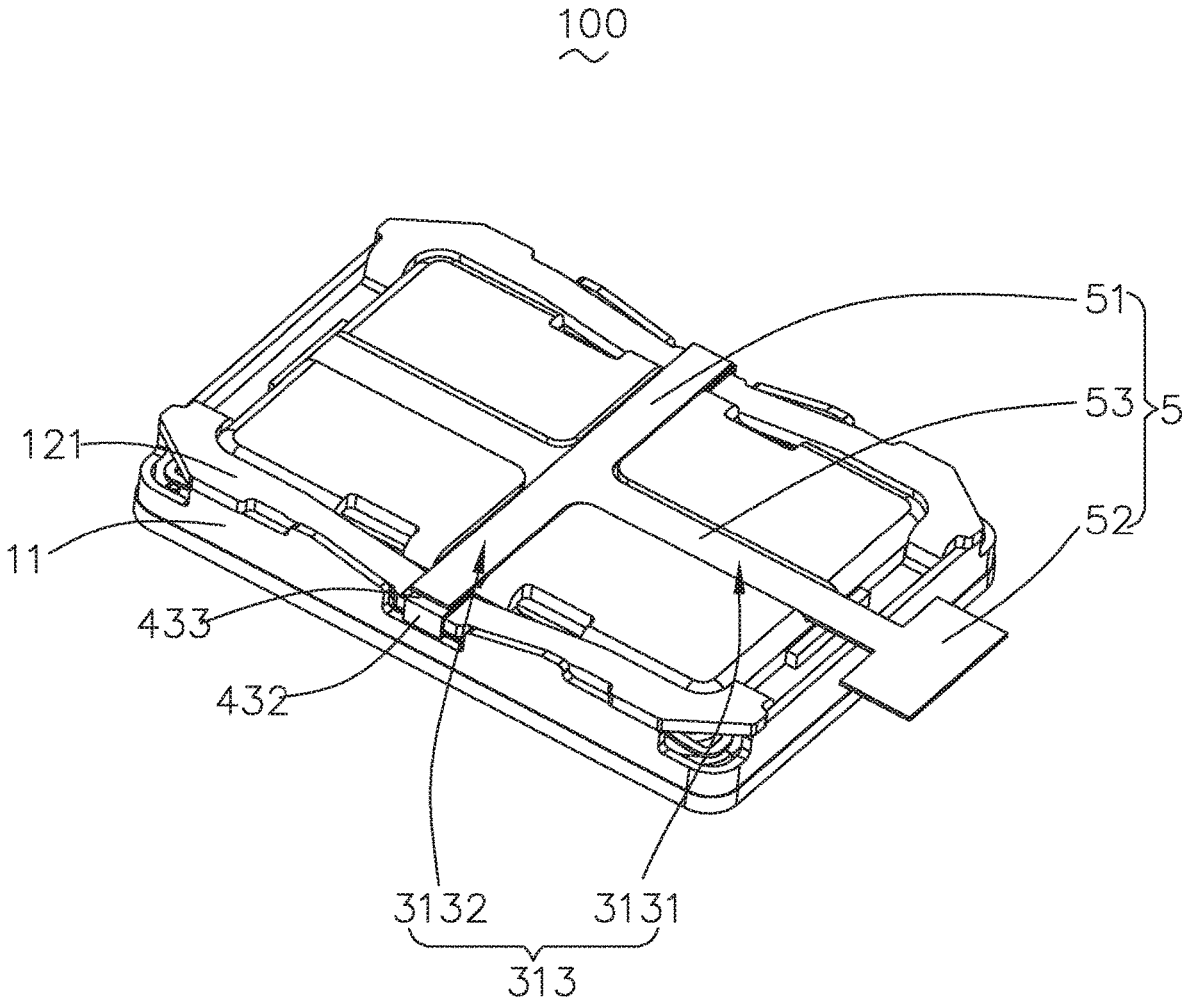
FIG. 8 is a perspective structural schematic diagram of the speaker shown in FIG. 1 when being viewed from another perspective.

Referring to FIG. 7 and FIG. 8, the printed circuit board 5 has a "T" structure, and includes a first portion 51 having two ends connected to the two pads 433 respectively, a second portion 52 arranged opposite to the first portion 51, and a third portion 53 connecting the first portion 51 with the second portion 52. The first portion 51 is correspondingly received in the second recess 3132, and the third portion 53 is correspondingly received in the first recess 3131. The second portion 52 extends from the third portion 53 to out of the speaker 100 for electrical connection with an external circuit.

As an example, the first portion 51 and the pad 433 are fixedly connected by hot-pressing solder-melting welding, such that the connection is firm and the number of flexible plate connectors can be reduced, thereby saving cost.

Compared with the related art, by providing a recess 313 at the lower surface 3111 of the yoke 31, receiving the printed circuit board 5 in the recess 313 and using the printed circuit board 5 for electrical connection between the electrical connection member 4 and an external circuit, the speaker 100 provided by the present disclosure can achieve reasonable utilization of space and obtain a smaller height of the finished product of the speaker 100, thereby meeting the demand for miniaturization.

What has been described above is only an embodiment of the present disclosure, and it should be noted herein that one ordinary person skilled in the art can make improvements without departing from the inventive concept of the present disclosure, but these are all within the scope of the present disclosure.

What is claimed is:

1. A speaker, comprising:

a holder having a receiving space;

a magnetic circuit unit received in the receiving space and comprising a yoke fixedly connected to the holder;

a vibration unit fixedly held by the holder; and an electrical connection member fixed at the holder, the vibration unit comprising a diaphragm and a voice coil located at a side of the diaphragm, and the electrical connection member being electrically connected to the voice coil; and a printed circuit board, wherein a pad fixed to the holder is formed at an end of the electrical connection member facing away from the voice coil, the yoke comprises a bottom plate exposed out of the holder, and a recess is formed at a side of the bottom plate facing away from the diaphragm, the printed circuit board is connected to the pad and is configured to electrically connect the electrical connection member with an external circuit, and the printed circuit board is received in the recess and extends to the pad.

2. The speaker as described in claim 1, wherein the printed circuit board matches the recess and is fixedly connected to the recess, and the printed circuit board has a thickness smaller than or equal to a depth of the recess.

3. The speaker as described in claim 1, wherein the yoke further comprises side plates extending from the bottom plate while being bent towards the diaphragm, the bottom plate and the side plates cooperating to form a receiving space, the bottom plate including an upper surface close to the diaphragm and a lower surface arranged opposite to the upper surface, and the recess being formed by recessing from the lower surface towards the upper surface.

4. The speaker as described in claim 3, wherein the holder comprises a frame body connected to the diaphragm and support edges provided at an end of the frame body facing away from the diaphragm and connected to the frame body, the support edge forming an opening, the yoke matching the support edge, the bottom plate being exposed via the opening, the pad being exposed at the support edge.

5. The speaker as described in claim 4, wherein the support edges comprise two first side edges arranged opposite to each other and two second side edges arranged opposite to each other, the first side edges and the second side edges are connected, head to tail, to form the opening, the pad is exposed at the first side edges, the recess comprises a first recess provided in parallel with the first side edges and a second recess provided in parallel with the second side edges, the first recess is in communication with the second recess, and the pad is provided at an end of the second recess facing away from the first recess.

6. The speaker as described in claim 5, wherein the first recess and the second recess have identical structures, each of the first recess and the second recess includes a recess bottom wall opposite to the upper surface and a recess sidewall extending from the recess bottom wall along a direction facing away from the upper surface, and the recess bottom wall is coplanar with the pad.

7. The speaker as described in claim 6, wherein the electrical connection member comprises a body portion supporting the voice coil, an elastic arm extending from the body portion and a fitting portion extending from the elastic arm to out of the holder, and the pad is formed at the fitting portion.

8. The speaker as described in claim 7, wherein the elastic arm is bent and extends from two opposite ends of the body portion towards opposite sides, the elastic arm and the body portion form a ring shape, and the fitting portion is formed at a middle portion of the elastic arm.

9. The speaker as described in claim 7, wherein the fitting portion further comprises an extension portion extending from the elastic arm along a direction facing away from the receiving space, and a connecting portion that is bent and extends from a distal end of the extension portion along a direction facing away from the diaphragm, the pad is formed by being bent and extending from an end of the connecting portion facing away from the extension portion, the pad is arranged opposite to the extension portion, and the support edge is sandwiched between the pad and the extension portion.

10. The speaker as described in claim 5, wherein there are two pads respectively provided on the two first side edges, the printed circuit board comprises a first portion having two ends connected to the two pads respectively, a second portion arranged opposite to the first portion, and a third portion connecting the first portion with the second portion, the first portion being correspondingly received in the second recess, the third portion being correspondingly received in the first recess, and the second portion extending from the third portion to out of the speaker and used for electrical connection with an external circuit.

11. The speaker as described in claim 10, wherein the first portion, the second portion, and the third portion are formed into one piece, the first portion and the second portion are parallel to each other, and two ends of the third portion are respectively located at a center position of the first portion and a center position of the second portion.

12. The speaker as described in claim 10, wherein the first portion is fixedly connected to the two pads by hot-pressing solder-melting welding.

13. The speaker as described in claim 1, wherein the holder is a metal holder.

* * * * *